US009226552B1

(12) United States Patent
Makhoulian et al.

(10) Patent No.: US 9,226,552 B1
(45) Date of Patent: Jan. 5, 2016

(54) PIERCED EARRING BACK FOR HANGING DECORATIVE ELEMENTS

(71) Applicant: Richline Group, New York, NY (US)

(72) Inventors: Mossig H. Makhoulian, New York, NY (US); Ralph S. Rossini, New York, NY (US)

(73) Assignee: Richline Group, New York, NY (US)

( * ) Notice: Subject to any disclaimer, the term of this patent is extended or adjusted under 35 U.S.C. 154(b) by 0 days.

(21) Appl. No.: 14/573,065

(22) Filed: Dec. 17, 2014

Related U.S. Application Data

(60) Provisional application No. 61/918,185, filed on Dec. 19, 2013.

(51) Int. Cl.
*A44C 7/00* (2006.01)

(52) U.S. Cl.
CPC ..... *A44C 7/003* (2013.01); *A44C 7/002* (2013.01); *Y10T 24/41* (2015.01)

(58) Field of Classification Search
CPC ..... A44C 7/002; A44C 7/003; A44C 25/001; A44C 25/007; Y10T 24/41
USPC ..... 24/705; 63/20, 1.18, 12, 13, 23; D11/40, 42, 86, 88
See application file for complete search history.

(56) References Cited

U.S. PATENT DOCUMENTS

| | | | | |
|---|---|---|---|---|
| 3,443,398 | A | 5/1969 | King, Jr. | |
| 4,218,894 | A | 8/1980 | Tropea | |
| 4,688,400 | A * | 8/1987 | Chioffe | 63/12 |
| 5,577,396 | A | 11/1996 | Cannon | |
| 5,588,309 | A | 12/1996 | Chioffe | |
| 7,155,932 | B2 | 1/2007 | Renter | |
| 8,443,626 | B2 | 5/2013 | Simpson et al. | |
| 8,850,674 | B1 | 10/2014 | Schechter et al. | |
| D727,778 | S * | 4/2015 | Levinson et al. | D11/86 |
| 2008/0148773 | A1 * | 6/2008 | Thurber | 63/13 |
| 2008/0148774 | A1 | 6/2008 | Thurber | |
| 2014/0298860 | A1 * | 10/2014 | Westenburg | 63/12 |

FOREIGN PATENT DOCUMENTS

DE 9403692 U1 * 5/1994

* cited by examiner

*Primary Examiner* — Abigail Morrell
(74) *Attorney, Agent, or Firm* — Levisohn Berger LLP

(57) ABSTRACT

A pierced earring back has a bottom open portion bounded by a bottom support bar and a finger entry mechanism to allow jump rings attached to dangles to be connected to the earring back to enhance the appearance of the earring backs. The earring back is formed of a substantially inverted egg shape with a substantially planar upper portion while the bottom support bar comprises a bent structure at its free end assisting in the placing and removing of the decorative element therein.

5 Claims, 4 Drawing Sheets

PIERCED EARRING BACK FOR HANGING DECORATIVE ELEMENTS

RELATED APPLICATIONS

This application claims the priority of provisional patent application Ser. No. 61/918,185, filed Dec. 19, 2013, the substance of which is incorporated herein.

BACKGROUND OF THE INVENTION

The invention relates to providing structural support and secure means for holding dangles or drops which can be attached to an earring back for pierced ears.

The concept of using a butterfly earring back or other pierced ear earring back as a support for holding drops or dangling ornaments is in the prior art. A patent to Renter, U.S. Pat. No. 7,155,932, shows one version which is relatively complex and requires additional means to hold at least a single dangling element. It requires more than just the earring back, and additional parts are required to hold the dangling ornament(s).

A patent to King, U.S. Pat. No. 3,443,398, shows the use of a stud earring passing through an ear and has a single ornamental drop secured behind the ear to a complex special plate constructed for holding such drop.

A patent to Chioffe, U.S. Pat. No. 5,588,309, shows a relatively complex structure for having an unusual earring back integral with a rail and hanger assembly to which a dangling ornament may be attached.

The prior art fails to show the provision of an earring back for handling more than a single drop and further fails to show means for easy and secure insertion of earring drops onto an integral region of an earring back which also can hold a plurality of earring drops at the same time.

The invention will be more fully understood with reference to the photographs of the invention attached hereto.

DETAILED DESCRIPTION OF THE PREFERRED EMBODIMENT

Figure 1:
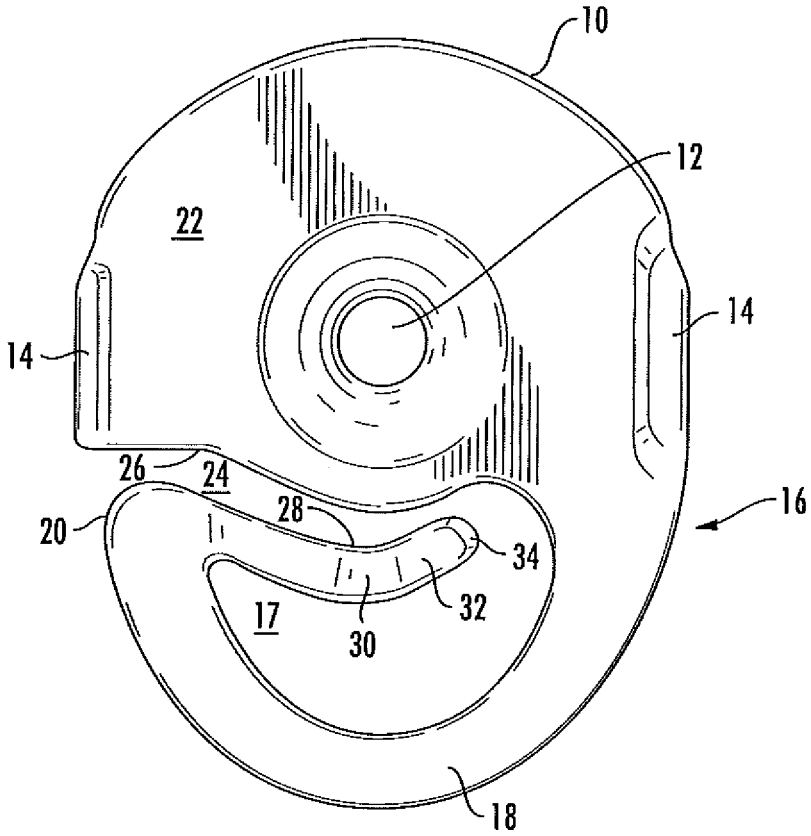
FIG. 1 is a front plan view of an earring back of this invention.
Figure 2:
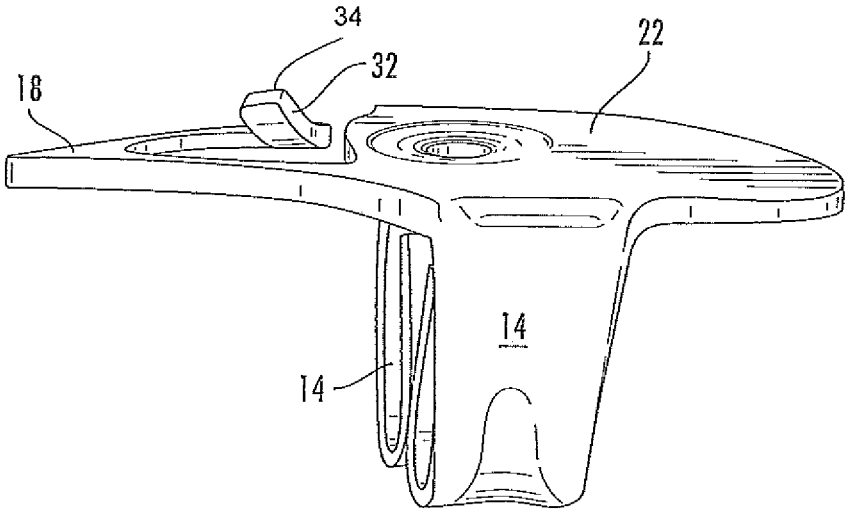
FIG. 2 is a right side plan view of the earring of FIG. 1.
Figure 3:
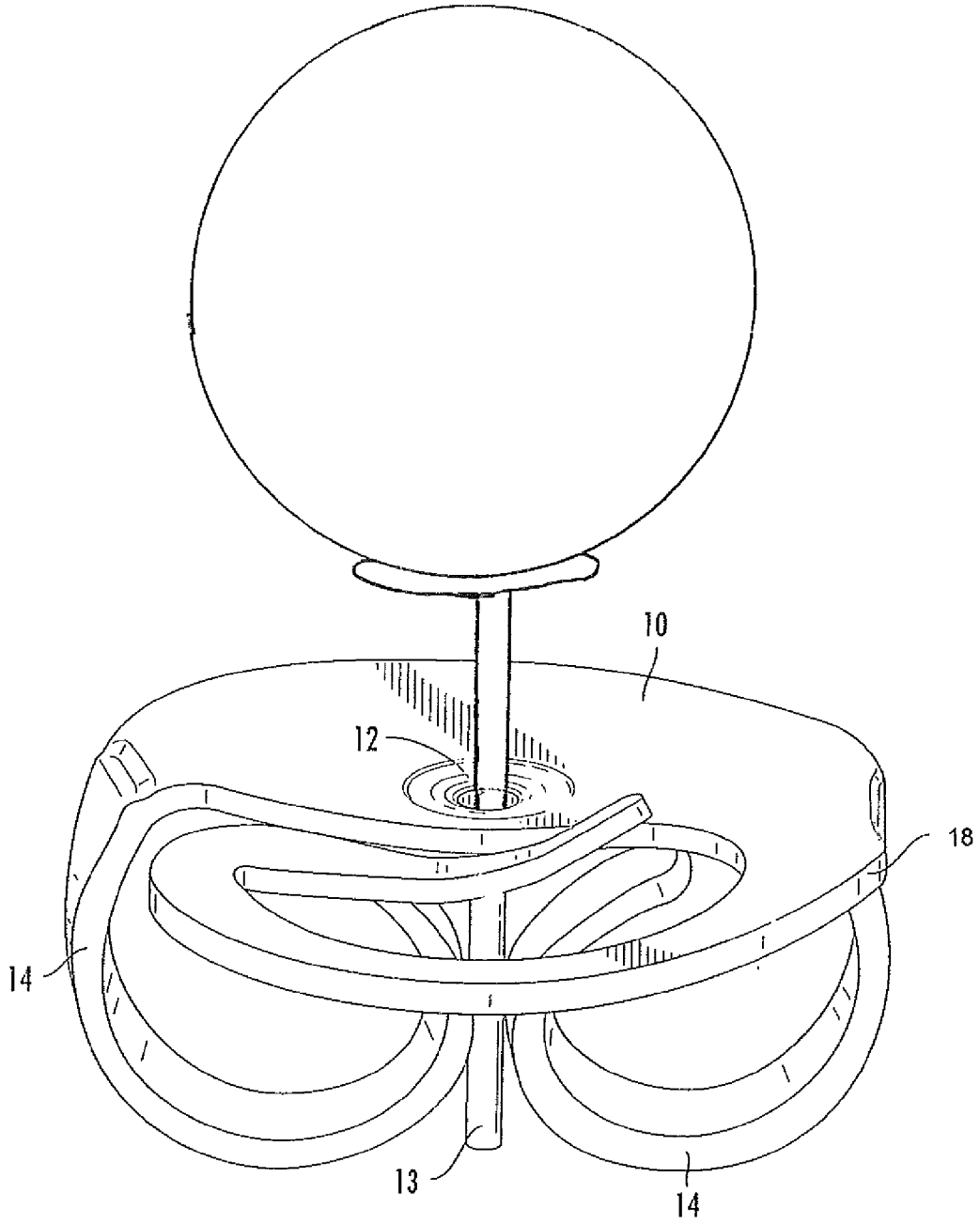
FIG. 3 is a top plan perspective view of the earring back.

FIG. 1 is a front plan view of a unitary structure earring back 10 of this invention which has a center hole or aperture 12, with a butterfly connection 14 formed in the rear of the earring back as an extension of opposite wings 14 seen from the front in FIG. 1. The post or pin 13 (FIG. 3) of a pierced ear earring is then captured between the butterfly wings 14 as it passes through aperture 12.

Figure 4:
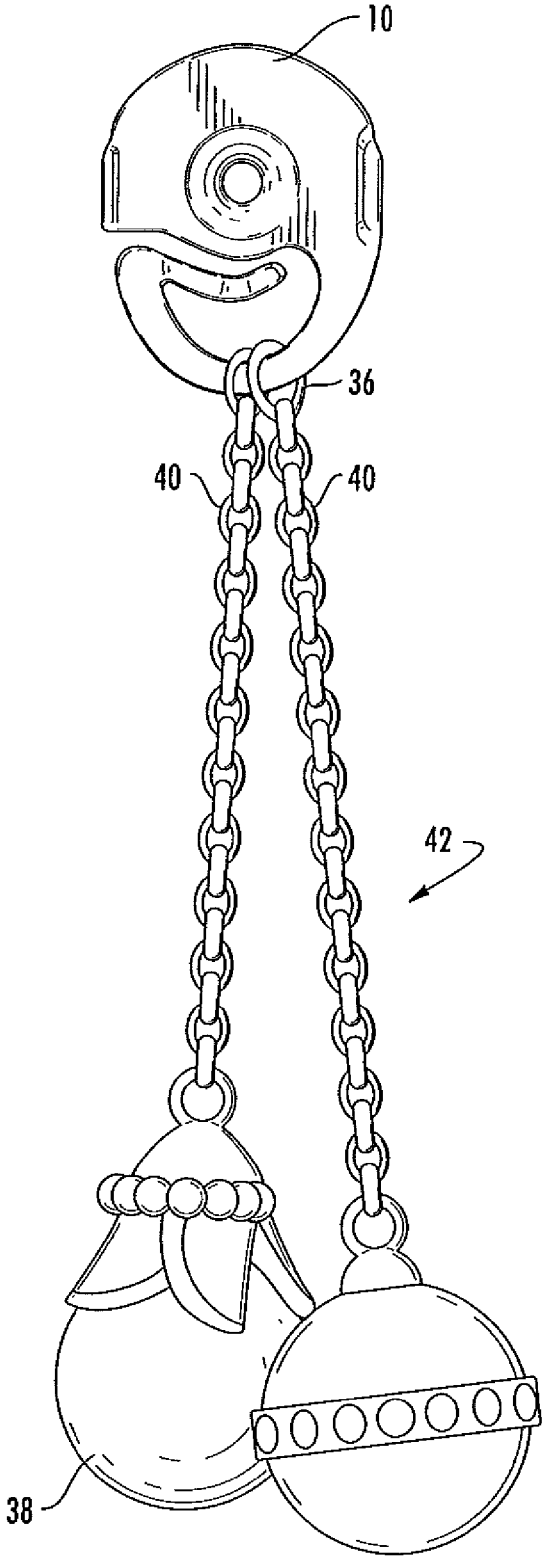
FIG. 4 is a front plan view of a plurality of drops shown attached to the earring back.

In accordance with the principles of the present invention, the lower half 16 of the earring back 10 is provided with a substantially open area 17 having a bottom support arm portion 18 of a rounded form terminating upwardly at elbow 20 toward the upper portion 22 of earring back 10. A channel 24 is formed between the bottom 26 of upper portion 22 of the earring back and the upper edge 28 of a finger 30 disposed inwardly from elbow 20. Channel 24 formed between surfaces 26 and 28 terminates in a raised projecting tail 32. Tail 32 terminates at its end 34 which is the point where a jump ring 36 (FIG. 4) of dangle 38 is slid onto and guided on the earring back to rest on lower arm 18 by sliding ring 36 along finger 30 to elbow 20 and then sliding down arm 18 to rest at its bottom most location. Support arm 18 itself completes the general bottom rounded shape of the earring back 10.

Channel 24 is slightly narrower at the tail end 34 to ensure that jump ring 36 is hard to slide off arm 18. Raised projecting tip 32 bent outside the plane of earring back 10 facilitates easy insertion and removal of jump ring 36 by providing additional clearance as a person slides or removes the dangle or earring drop 38 from earring back 10 along finger 30.

The earring back 10 is of a substantially rounded inverted egg shape.

As another feature of this invention the first few links 40 (FIG. 4) a plurality of chains 42 may be soldered together to form a more solid structure enabling the consumer to more easily manually handle and direct the jump rings 36 while adding or removing the drops 38 from the earring back. In any case, upper and lower portions 22 and 16 are substantially coplanar and flat.

While the earring back 10 of this invention is shown as a substantially complete inverted egg shape, most of the upper portion 24 could be eliminated while retaining the structure to hold drops on an earring back.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. A pierced earring back for hanging decorative elements attached to a ring, said earring back comprising:

a unitary structure having height and width, said unitary structure having an aperture therein permitting passage of a post of a pierced earring, a substantially planar upper portion with said aperture located therein, a decorative element hanging structure comprising a lower portion integrally formed as said unitary structure with said upper portion, said lower portion having an open area bordered by a bottom support arm substantially extending across the width of said unitary structure, an upper edge of said substantially planar upper portion and a bottom edge of said bottom support arm together defining a substantially inverted egg shaped silhouette of the earring back, said lower portion comprising a finger on which said ring passes from outside the periphery of the earring back to said open area in said lower portion, said support arm integrally formed in said lower portion on which said ring is carried to hold said decorative elements thereon, said support arm terminating in an elbow integrally formed with said finger, said finger having an upper edge separated from the bottom of said upper portion to form a channel, said channel enabling said ring to pass on said finger to said elbow to then move downwardly on said bottom support arm.

2. The pierced earring back according to claim 1, further comprising a tail portion at the end of said finger, said tail portion bent outside the plane of said earring back to assist in attaching and removing said decorative elements from said finger.

3. The pierced earring back according to claim 2, wherein said tail portion is bent upwardly with respect to said earring back.

4. The pierced earring back according to claim 1, wherein said upper and lower portions are substantially in the same plane.

5. The pierced earring back according to claim 4, wherein said upper and lower portions are substantially flat.

* * * * *